US005722481A

United States Patent [19]

Yamada et al.

[11] Patent Number: 5,722,481

[45] Date of Patent: Mar. 3, 1998

[54] METHOD FOR CASTING METAL AND APPARATUS THEREFOR

[75] Inventors: Junji Yamada, Aichi; Noboru Demukai, Gifu; Masayuki Yamamoto, Aichi, all of Japan

[73] Assignee: Daido Tokushuko Kabushiki Kaisha, Nagoya, Japan

[21] Appl. No.: 637,416

[22] Filed: Apr. 25, 1996

[51] Int. Cl.[6] ..... B22D 27/02

[52] U.S. Cl. ..... 164/493; 164/513

[58] Field of Search ..... 164/493, 498, 164/513, 147.1

[56] References Cited

FOREIGN PATENT DOCUMENTS 0 457 502 11/1991 European Pat. Off. .

*Primary Examiner*—Kuang Y. Lin

*Attorney, Agent, or Firm*—Wenderoth, Lind & Ponack

[57] ABSTRACT

Molten metal melted in a levitation melting furnace is cast through a suction pipe immersed therein from above into a mold having a gas permeability in a double-structure mold chamber arranged directly above the melting furnace. The metal is levitation-melted in an inert atmosphere under atmospheric pressure. An outer mold chamber of the double-structure mold chamber is joined to the levitation melting furnace. Pressure in the outer mold chamber and in an inner mold chamber of the double-structure mold chamber and in an upper space in the levitation melting furnace is reduced to below atmospheric pressure. The suction pipe arranged in the inner mold chamber and communicating with the mold therein is immersed into the molten metal. The molten metal is cast into the mold under an increased pressure by blowing an inert gas into the upper space in the melting furnace. The inner mold chamber is raised, thereby pulling out the suction pipe from the molten metal. The outer mold chamber is raised after being returned to atmospheric pressure to separate from the melting furnace.

15 Claims, 5 Drawing Sheets

METHOD FOR CASTING METAL AND APPARATUS THEREFOR

FIELD OF THE INVENTION

The present invention relates to a method of casting metal and an apparatus therefor. More particularly, the present invention relates to a novel metal casting method and an apparatus for the application of such method, which permit achievement of a high-quality casting free from entrapment of impurities, gas contamination or gas defects, and which are useful particularly for casting active metals such as titanium.

PRIOR ART AND PROBLEMS

Various types of methods and apparatuses for casting metal have conventionally been known. For these casting methods and apparatuses, diverse and various means for obtaining high-quality products free from entrapment of impurities, gas contamination or gas defects have been examined and industrialized.

The present inventors carried out extensive studies on means for obtaining such high-quality casting products, and have established a method of permitting casting of an active metal particularly including active and high-melting-point titanium and an alloy thereof, and allowing casting at a high efficiency with a high productivity.

The method thus established is essentially characterized by the combination of semi-levitation melting of metal comprising melting a metal by partially magnetic-floating of the metal, and reduced-pressure suction casting. Such method permits melting and casting of an active metal such as titanium by the semi-levitation melting process, different from the conventional process using a refractory crucible, inhibits deterioration of quality caused by refractory contamination, and makes it possible to conduct continuous melting and casting and to carry out casting of highly uniform castings and ones with complicated shapes by the application of the reduced-pressure casting process.

The semi-levitation melting process forming a feature of this method will be described in further detail below. This process is a kind of levitation (magnetic floating) melting process which comprises induction-heating a material charged into a melting crucible, and holding the resultant molten material without causing contact with the inner wall of the melting crucible.

More specifically, the levitation melting process is one of the melting processes which comprise, when melting a metallic material charges in a melting crucible, preventing the molten metal from being contaminated by chemical reactions caused by contact of the metal with the inner wall of the crucible, thereby achieving quality improvement. There are two types of levitation melting processes. The full-levitation melting process comprises causing molten metal to fully float in the air by the action of electromagnetic force, and the semi-levitation melting process comprises using a water-cooled copper crucible, and causing the molten metal to float by electromagnetic force while keeping the bottom of the material in a solidified state. In the full-levitation melting process, although contamination from the melting crucible can be fully prevented because the molten metal is fully floated, it is difficult to keep the molten metal in the floating state, and the quantity of molten metal capable of being floated is too small to be employed industrially. For industrial purposes, therefore, the semi-levitation melting process is commonly employed.

An outline of the semi-levitation melting process is as follows. In the water-cooled copper crucible used in this melting process, a peripheral wall of the main body formed into a cylindrical shape having a bottom is circumferentially divided to form a plurality of segments into which cooling water is circulated, and the individual segments are insulated from each other with an insulating material. Doughnut-shaped high-frequency induction coil turns are arranged at prescribed annular intervals on the outside of the water-cooled copper crucible. The material is induction-heated upon charging the material into the crucible by supplying high-frequency current to the induction coil. Upon heating the material to a prescribed temperature, the material partially melts while keeping the bottom in contact with the bottom of the water-cooled copper crucible in the solidified state, and is kept floating in a non-contact state relative to the inner wall of the crucible under the effect of electromagnetic force generated by the penetration of the molten material into the crucible.

The levitation melting process as a melting process having the features as described above is simply called "levitation melting" in the description of the present application hereafter.

The casting method established by the prevent inventors, using levitation melting as described above, and an apparatus for the application thereof are characterized in that, as shown in FIG. 5 for example, a suction pipe (d) connecting with a mold (c) arranged above a melting furnace (a) is immersed in molten metal (b) in furnace (a), and the molten metal (b) is sucked up for casting into the mold (c) through the suction pipe (d) under conditions including reducing pressure in the mold (c) and a mold chamber (e) to below atmospheric pressure.

In the conventional method and apparatus, however, there were left points to be improved in terms of improvement of casting efficiency along with reduced-pressure suction and uniform casting into the mold. More specifically, there was a demand for development of means to improve productivity of levitation melting and reduced-pressure suction casting and to permit more uniform casting into the mold while avoiding occurrence of defects resulting from casting.

SUMMARY OF THE INVENTION

As means to solve the above-mentioned problems, the present invention provides a method for casting a molten metal melted in a levitation melting furnace through a suction pipe immersed therein from above into a mold having a gas permeability in a double-structure mold chamber arranged directly above the melting surface, such method comprising the steps of:

(A) levitation-melting a metal in an inert atmosphere under atmospheric pressure;

(B) contacting an outer mold chamber of the double-structure mold chamber to the levitation melting furnace;

(C) reducing pressure in the outer mold chamber and in an inner mold chamber of the double-structure mold chamber and in an upper space in the levitation melting furnace to below atmospheric pressure;

(D) immersing the suction pipe arranged in the inner mold chamber and connected with the mold therein into the molten metal;

(E) casting the molten metal into the mold under an increased pressure by blowing an inert gas into the upper space in the melting furnace;

(F) lifting up the inner mold chamber, thereby pulling the suction pipe from the molten metal; and (G) lifting up the outer mold chamber, after returning to atmospheric pressure, to separate from the melting furnace.

The present invention also provides an apparatus for casting a metal, which comprises a levitation meting furnace, a suction pipe which is arranged directly above the levitation melting furnace and which sucks up molten metal into a gas-permeable mold retaining a mold into which the molten metal is cast, a double-structure mold chamber having an inner mold chamber allowing the suction pipe to connect with the mold and an outer mold chamber forming the outer periphery thereof, a sliding mechanism causing the inner mold chamber and the outer mold chamber to move independently up and down, and an atmosphere control mechanism, and wherein:

(a) a metal is melted in an inert atmosphere under atmospheric pressure in the levitation furnace;

(b) the sliding mechanism contacts the outer mold chamber of the double-structure mold chamber to the levitation melting furnace;

(c) the atmosphere control mechanism reduces pressure in the outer mold chamber and the inner mold chamber in the double-structure mold chamber and in the upper space in the levitation melting furnace to below the atmospheric pressure;

(d) the sliding mechanism lowers the inner mold chamber, whereby the suction pipe provided in the inner mold chamber and connected with the mold therein is immersed into the molten metal;

(e) the atmosphere control mechanism blows an inert gas into the upper space of the melting furnace to cast the molten metal into the mold;

(f) the sliding mechanism raises the inner mold chamber, thereby pulling out the suction pipe from the molten metal; and (g) after returning to atmospheric pressure, the sliding mechanism raises the outer mold chamber which is separated from the levitation melting furnace.

The present invention further provides embodiments wherein:

a mold keeper is arranged to press and keep the mold in the inner mold chamber;

wherein the sliding mechanism has an elastic body, compression of which causes descent and a repulsive force of which causes ascent; and wherein the atmosphere control mechanism is provided with exhaust pressure reducing means and inert gas supply means.

DETAILED DESCRIPTION OF THE INVENTION

In the present invention, as described above, in which the interior of the mold is kept under a reduced pressure or vacuum under the effect of the double structure of the mold chamber and the molten metal is cast by pressurizing, defects occurring from entrapment by atmosphere gas are not caused, thus permitting casting of a uniform structure. In addition, all of the operations of casting including stabilization and fin adjustment of the casting speed are very efficiently accomplished by the generation of a difference in pressure caused by blowing of the inert gas.

The present invention, furthermore, based on levitation melting, is suitable for casting of an active metal such as titanium, and because of the absence of inclusions caused by crucible refractories, is effective for ferrous castings.

Now, the method and the effects of the present invention will be described in further detail by way of examples.

EXAMPLES

Figure 1:
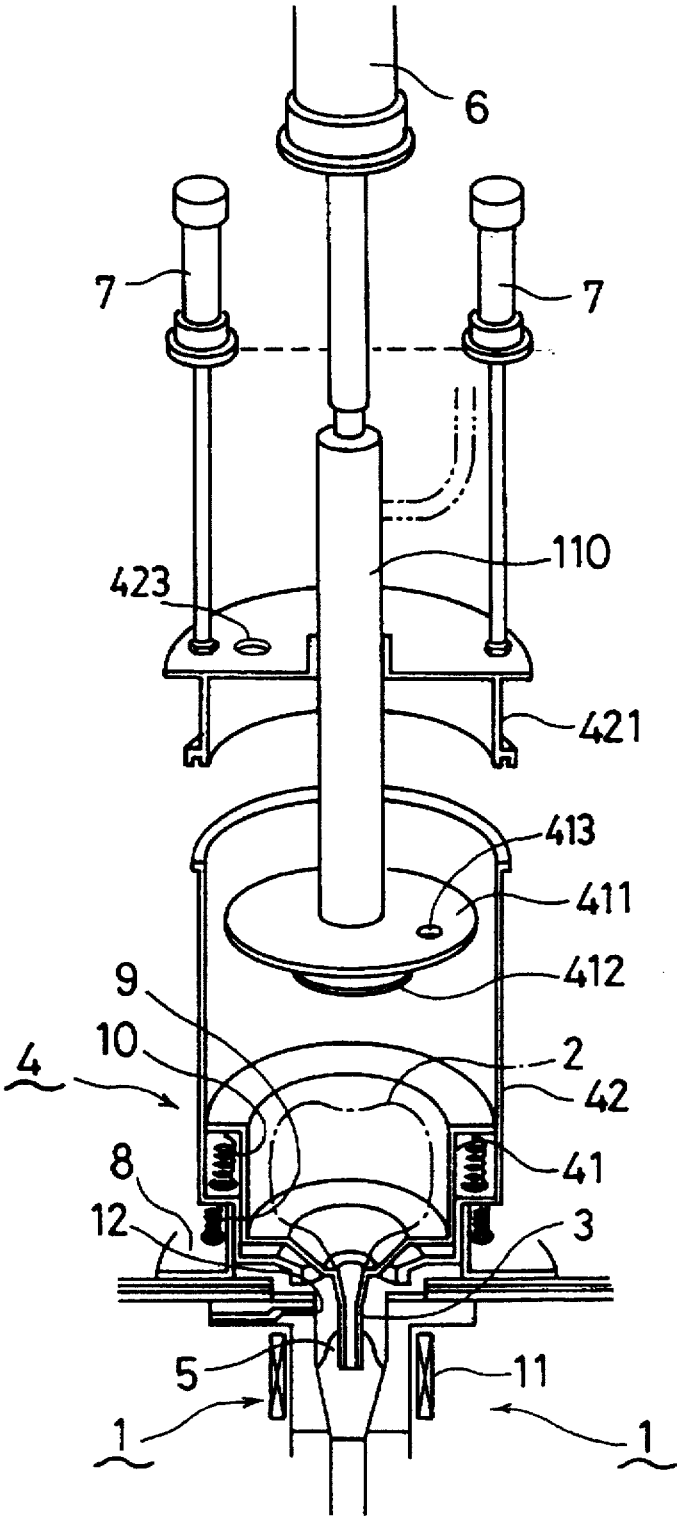
FIG. 1 is a partial perspective sectional view illustrating the casting apparatus of the present invention.
Figure 2:
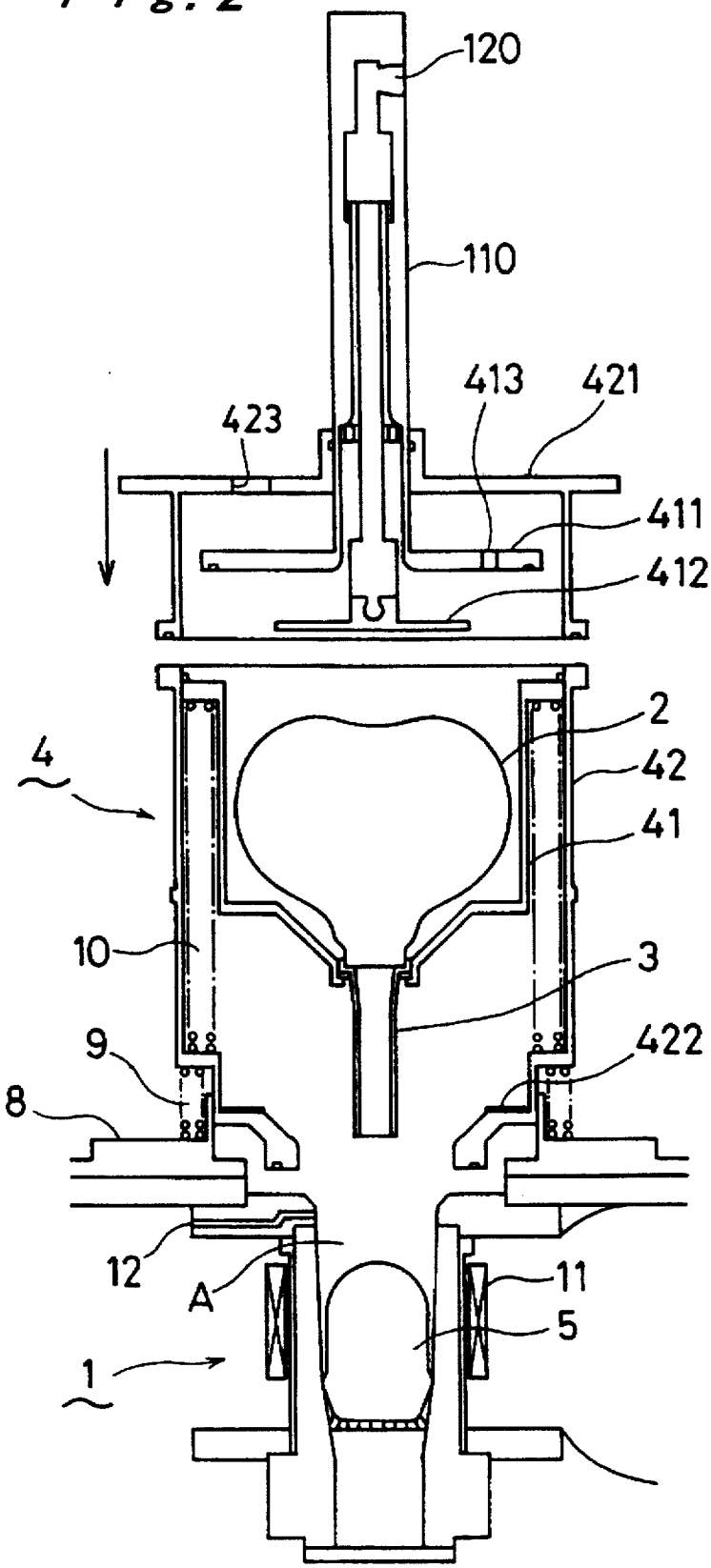
FIG. 2 is a sectional view illustrating an embodiment of a descending operation of an outer cover above an outer mold chamber in the apparatus shown in FIG. 1.
Figure 3:
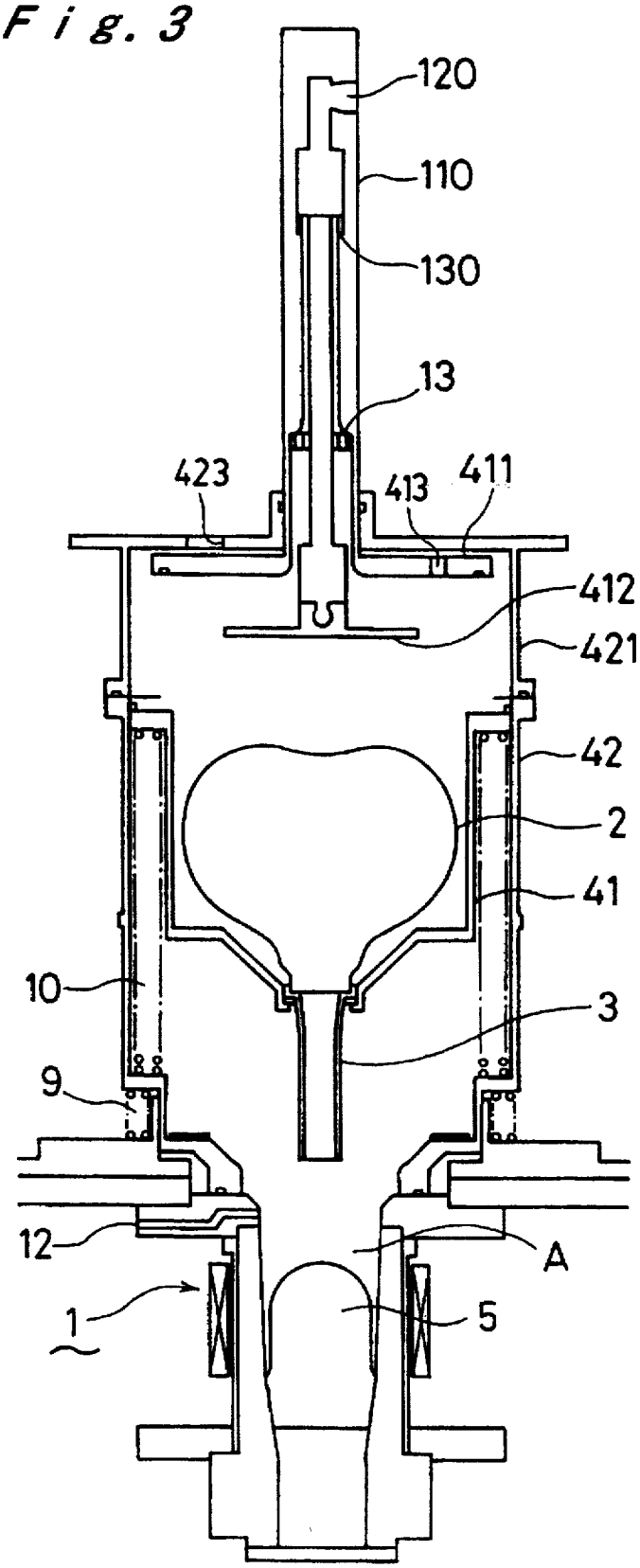
FIG. 3 is a sectional view illustrating an embodiment of a descending operation of the outer mold chamber and joining to a levitation melting furnace, following the operation shown in FIG. 2.
Figure 4:
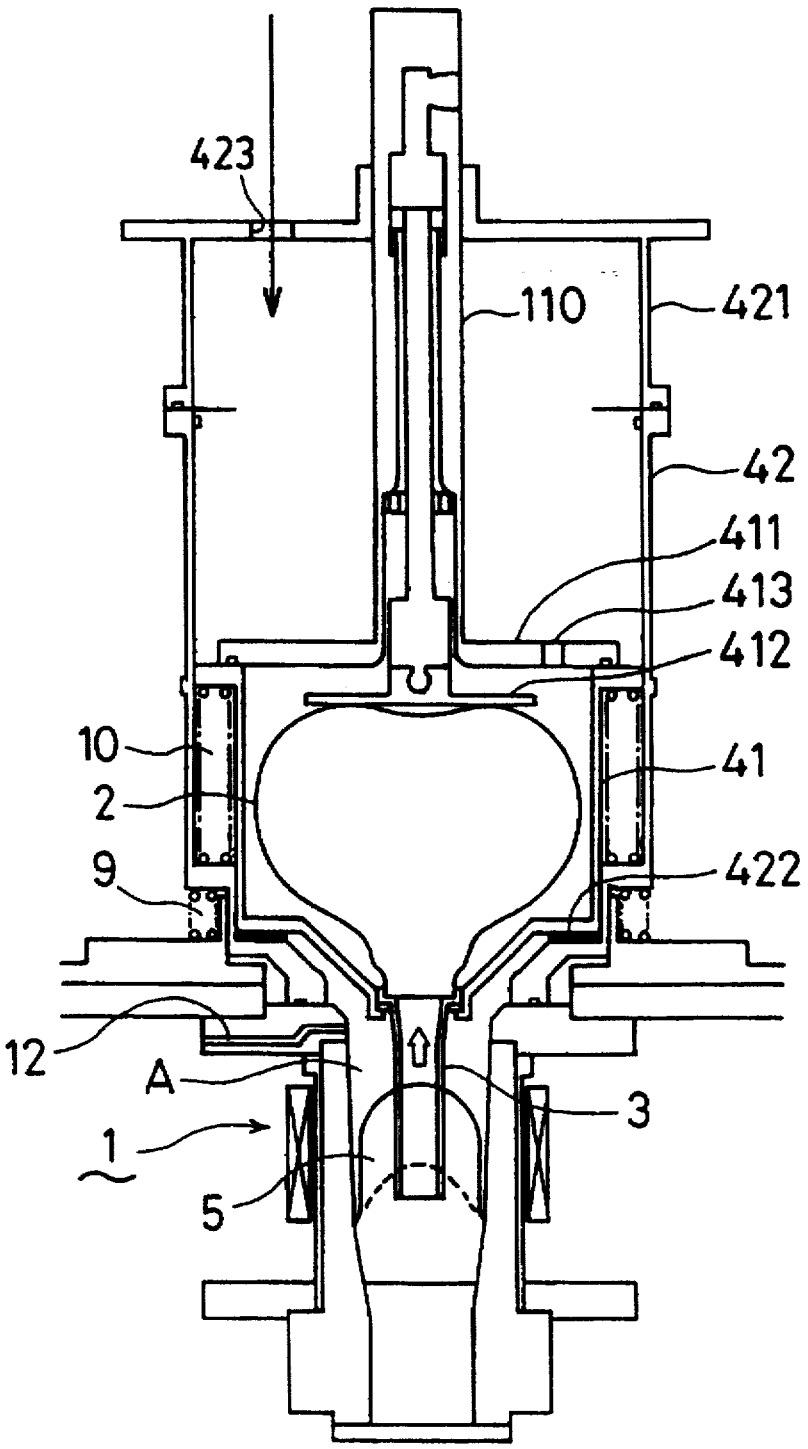
FIG. 4 is a sectional view illustrating descent of an inner mold chamber and a casting operation, following the operation shown in FIG. 3.
Figure 5:
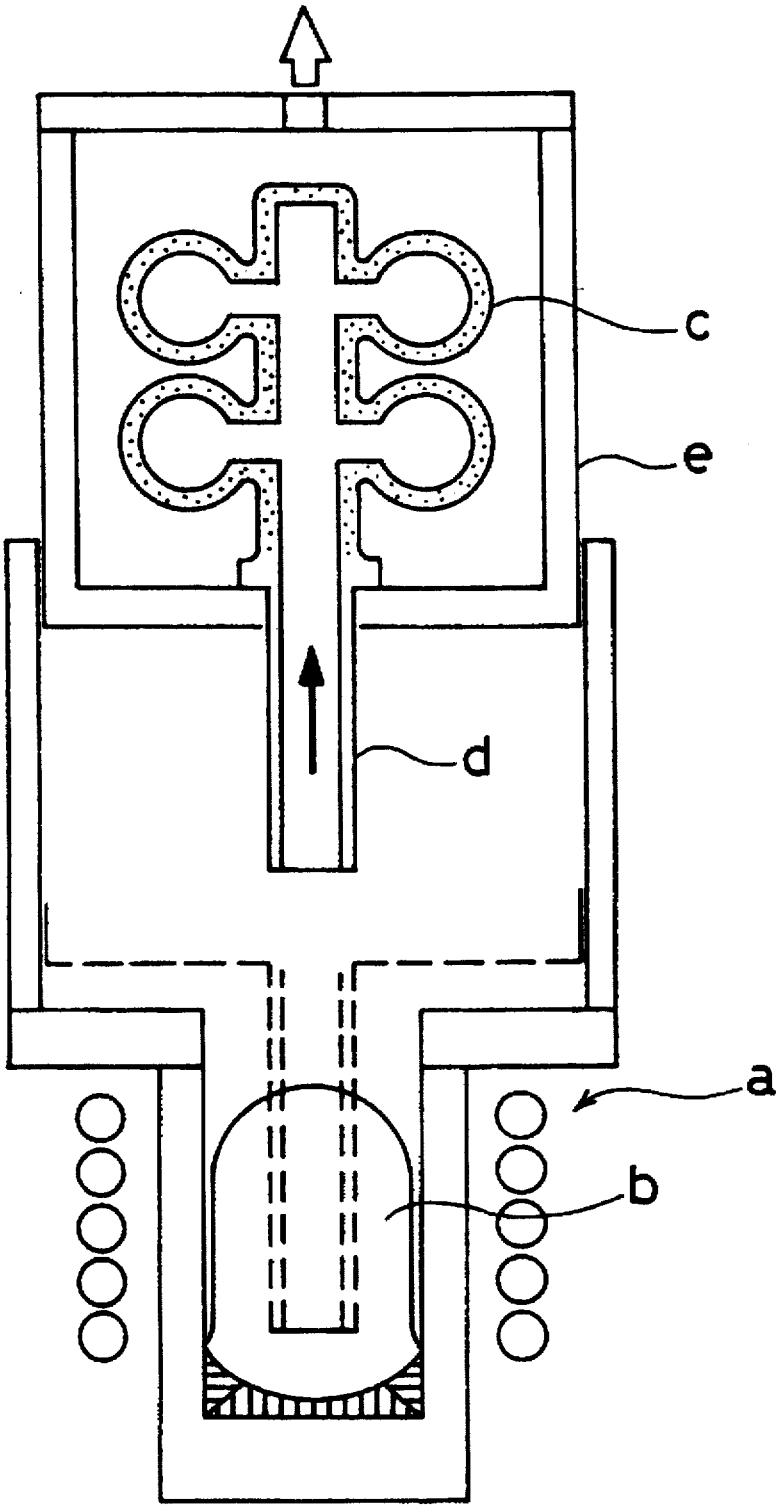
Fig. 5 PRIOR ART
FIG. 5 is a sectional view illustrating a conventional apparatus and method.

FIG. 1 is a perspective sectional view illustrating an embodiment of the apparatus for the application of the casting method of the present invention, and FIGS. 2 to 4 are sectional views of casting sequential operations of such method.

For example, as shown in FIGS. 1 to 4, the casting apparatus of the present invention is provided with a levitation melting furnace (1), and a mold chamber (4) which holds in the interior thereof a gas-permeable mold (2) into which the molten metal is to be cast and which has a suction pipe (3) for sucking up the molten metal into mold (2). The mold (2) is not limited to a precision-casting mold based on the lost wax process, but any of various molds using sand, a metal or the like which is permeable may be used.

The mold chamber (4) has a double structure comprising an inner mold chamber (41) having mold (2) arranged therein and connecting suction pipe (3) to the mold (2) and an outer mold chamber (42) forming the outer periphery thereof. The casting apparatus is provided with a sliding mechanism which moves the inner mold chamber (41) and the outer mold chamber (42) independently up and down, and an atmosphere control mechanism.

In this embodiment, furthermore, an inner cover (411) with a vent hole (413) for the inner mold chamber (41) and a mold keeper (412) for pressing the mold (2) from above are provided to be vertically slidable, and an outer cover (421) with a vent hole (423) for the outer mold chamber (42) is provided to be vertically slidable. The inner cover (411) and the outer cover (421) are vertically slidable by independently operating cylinder mechanisms (6) and (7). An outer spring (9) is provided between the outer mold chamber (42) and a base (8), and an inner spring (10) is provided between a flange portion of the inner mold chamber (41) and a staged portion of the outer mold chamber (42).

Casting operations now will be described in further detail with reference to FIGS. 2 to 4.

I. In the levitation melting furnace (1) in the state shown in FIG. 2, melting of a metal is started by adjusting the atmosphere to include argon or the like in the upper space (A) by supplying an inert gas such as argon (Ar) through a gas supply port (12) while operating an induction coil (11). Molten metal (5) is generated almost at the center by minimizing contact with the furnace wall, a feature of levitation melting.

II. The outer cover (421) is lowered by the cylinder piston mechanism (7) shown in FIG. 1 toward the outer mold chamber (42) to close the outer mold chamber with outer cover (421). At the same time, as shown in FIG. 3, the outer spring (9) is compressed to bring the outer mold chamber (42) composing the double-structure mold chamber into close contact with the levitation melting furnace (1). In this state, an inert gas such as argon (Ar) is blown by the atmosphere control mechanism into the inner and the outer mold chambers (41 and 42). The inner and the outer mold chambers (41 and 42) are thus filled with the inert gas atmosphere.

III. Pressure in the outer mold chamber (42) and the inner mold chamber (41) forming the double-structure mold chamber, and in the upper space in the levitation melting furnace (1) is reduced to a pressure lower than atmospheric pressure (preferably to below 200 Torr, or more preferably, to below 100 Torr), through a gas guide (130) by an evacuation pump forming part of the atmosphere control mechanism, from an exhaust port (120) provided in slide 110 for sliding the inner cover (411).

IV. As shown in FIG. 4, the slide (110) is caused to descend by the above-mentioned cylinder piston mechanism (6), and the inner mold chamber (41) is moved down while compressing the inner spring (10) to immerse the suction pipe (3) connected with the mold (2) arranged therein into the molten metal (5). Confronting inner surfaces of a step between the inner mold chamber (41) and the outer mold chamber (42) are sealed with a packing material (422). The inner mold chamber (41) is closed by the inner cover (411), and the mold (2) is pressed by the mold keeper (412).

V. Simultaneously with immersion as described above, an inert gas such as argon (Ar) is blown into the upper space (A) in the melting furnace (1), and the molten metal (5) is pushed up by the difference in pressure (50 to 500 Torr) between the upper space (A) and the inner mold chamber (41). The molten metal (5) thus uniformly rises up through the suction pipe (3) and immediately is cat into the mold (2).

VI. After blowing argon gas by means of the atmosphere control mechanism into the inner and the outer mold chambers (41 and 42) and the above-mentioned space (A), and returning to atmospheric pressure, the outer mold chamber (42) is raised by the sliding mechanism described above to separate the outer mold chamber (42) and the inner mold chamber (41) from the levitation melting furnace (1). The suction pipe (3) consequently is pulled from the molten metal.

In the apparatus and the casting method using the apparatus of the present invention, as is clear from operations I to VI, the mold chamber (4) is more perfectly closed under the effect of the double structure comprising the inner mold chamber (41) and the outer mold chamber (42), and casting of a product free from defects at meniscus, having a uniform structure and containing minimum impurities made possible by the absence of entanglement by the atmosphere and uniform ascent of molten metal, resulting from casting by reduced pressure and inert gas pressurizing. Control of the atmosphere is also easier.

The outer spring (9), the inner spring (10) and the cylinder piston mechanisms (6) and (7) for ensuring the close contact and sliding properties of the inner mold chamber (41) and the outer mold chamber (42) are not limited to such particular illustrated structures.

Supply of inert gas for sealing the furnace is for levitation melting, and is continued throughout the entire period of casting except for the period of pressure reduction before casting.

After the completion of casting by the above-mentioned operations, wear of the suction pipe (3) is confirmed, and when the degree of wear is within a tolerable range, the mold (2) is removed and then materials are additionally charged into the melting furnace (1) to repeat the above operations.

By using a suction pipe made from the same metal as the molten metal or a base metal of molten ally, the wear tolerance of the suction pipe is increased. It is preferable to use a suction pipe made from Ti for melting Ti-Base-alloy.

According to the method and the apparatus of the present invention, as is clear from the examples shown above, it is possible to avoid entanglement of inclusions from crucible refractories by levitation melting, leading to easier casting of an active metal such as titanium. The atmosphere in the mold is controlled by the double structure of the mold chamber and the pressure reduction and casting by pressuring of the inert gas make it possible to cast a product with the least possible defects and that is excellent in uniformity of structure. Furthermore, the pressure difference achieved by the pressure reducing conditions and inert gas blowing permit efficient casting including stabilization and fine adjustment of the casting speed, with a largely improved productivity.

What is claimed is:

1. A method of casing molten metal, said method comprising:

levitation-melting metal in an inert atmosphere under atmospheric pressure in a levitation-melting furnace to thereby form molten metal, said furnace having positioned thereabove a double-structure mold chamber including an outer mold chamber, an inner mold chamber within said outer mold chamber, a gas-permeable mold within said inner mold Chamber and a suction pipe connected to said mold and extending downwardly from said inner mold chamber;

lowering said outer mold chamber toward said furnace;

reducing pressure in said double-structure mold chamber and in an upper space of said furnace to below atmospheric pressure;

lowering said inner mold chamber and thereby immersing said suction pipe in said molten metal;

blowing inert gas into said upper space and thereby injecting said molten metal into said mold;

raising said inner mold chamber and thereby removing said suction pipe from said molten metal; and returning said double structure mold chamber to atmospheric pressure and raising said outer mold chamber.

2. A method as claimed in claim 1, further comprising maintaining said mold in said inner mold chamber by lowering a mold keeper thereto.

3. A method as claimed in claim 2, comprising lowering said mold keeper during said lowering said inner mold chamber.

4. A method as claimed in claim 1, wherein said lowering said outer mold chamber comprises moving an outer cover downwardly into contact with said outer mold chamber and causing said outer cover to move said outer mold chamber downwardly.

5. A method as claimed in claim 4, further comprising biasing said outer mold chamber upwardly.

6. A method as claimed in claim 1, wherein said lowering said inner mold chamber comprises moving an inner cover downwardly into contact with said inner mold chamber and causing said inner cover to move said inner mold chamber downwardly.

7. A method as claimed in claim 6, further comprising biasing said inner mold chamber upwardly.

8. An apparatus for casing metal, said apparatus comprising:

a levitation-melting furnace to melt metal to form molten metal;

a double-structure mold chamber positioned above said furnace and including a vertically movable outer mold chamber, an inner mold chamber within said outer mold chamber and vertically movable independently of movement thereof, a gas-permeable mold within said inner mold chamber and a suction pipe connected to said mold and extending downwardly from said inner mold chamber;

means for vertically moving said outer mold chamber and said inner mold chamber independently of each other;

atmosphere control means for controlling the atmosphere and pressure in said mold chamber and in an upper space of said furnace; and whereby said moving means is operable to lower said outer mold chamber toward said furnace, said atmosphere control means is operable to reduce the pressure in said mold chamber and in said upper space to below atmospheric pressure, said moving means is operable to lower said inner mold chamber to thereby immerse said suction pipe in the molten metal in said furnace, said atmosphere control means is operable to blow inert gas into said upper space to thereby inject the molten metal through said suction pipe into said mold, said moving means is operable to raise said inner mold chamber to thereby remove said suction pipe from the molten metal, said atmosphere control means is operable to return said mold chamber to atmospheric pressure, and said moving means is operable to raise said outer mold chamber.

9. An apparatus as claimed in claim 8, wherein said atmosphere control means includes a pressure-reducing means and an inert gas supply means.

10. An apparatus as claimed in claim 8, further comprising an outer cover for covering said outer mold chamber, and wherein said moving means is operable to lower said outer cover to contact said outer mold chamber and to cause said outer cover to move said outer mold chamber downwardly.

11. An apparatus as claimed in claim 10, further comprising an outer elastic member biasing said outer mold chamber upwardly.

12. An apparatus as claimed in claim 8, further comprising an inner cover for covering said inner mold chamber, and wherein said moving means is operable to lower said inner cover to contact said inner mold chamber and to cause said inner cover to move said inner mold chamber downwardly.

13. An apparatus as claimed in claim 12, further comprising an inner elastic member biasing said inner mold chamber upwardly.

14. An apparatus as claimed in claim 13, wherein said inner elastic member biases said inner mold chamber upwardly relative to said outer mold chamber.

15. An apparatus as claimed in claim 8, further comprising a vertically movable mold keeper, and wherein said moving means is operable to move said mold keeper downwardly to a position to maintain said mold in position within said inner mold chamber.

* * * * *